US005801523A

United States Patent [19]

Bynum

[11] Patent Number: 5,801,523

[45] Date of Patent: Sep. 1, 1998

[54] CIRCUIT AND METHOD OF PROVIDING A CONSTANT CURRENT

[75] Inventor: Byron Glen Bynum, Gilbert, Ariz.

[73] Assignee: Motorola, Inc., Schaumburg, Ill.

[21] Appl. No.: 799,680

[22] Filed: Feb. 11, 1997

[51] Int. Cl.[6] ..... G05F 3/16

[52] U.S. Cl. ..... 323/315; 330/288

[58] Field of Search ..... 323/315; 327/530; 330/288

[56] References Cited

U.S. PATENT DOCUMENTS

| | | | |
|---|---|---|---|
| 4,855,618 | 8/1989 | Brokaw | 307/296.6 |
| 5,252,910 | 10/1993 | Agaesse | 323/315 |
| 5,359,296 | 10/1994 | Brooks et al. | 330/288 |
| 5,525,927 | 6/1996 | Yung et al. | 323/315 |
| 5,589,800 | 12/1996 | Peterson | 323/315 |
| 5,654,629 | 8/1997 | Theus | 323/315 |
| 5,680,038 | 10/1997 | Fiedler | 323/315 |
| 5,696,440 | 12/1997 | Harada | 323/315 |

*Primary Examiner*—Stuart N. Hecker
*Attorney, Agent, or Firm*—Robert D. Atkins

[57] ABSTRACT

A current source (20) uses a current mirror having an input coupled for receiving a first reference current. A first transistor (34) is serially coupled in the input of the current mirror. A second transistor (38) has a first conduction terminal coupled for receiving a second reference current, and a second conduction terminal coupled to an output of the current mirror. The first conduction terminal of the second transistor is coupled to common control inputs (42) of the first and second transistors. As the output voltage of the current source decreases the current mirror transistors are forced to have the same drain-source voltage and gate voltage, and operate at substantially the same point in their linear region. The tracking of the drain-source voltages of the current mirror transistors allow the current source to maintain a constant output current when operating at very low output voltages.

14 Claims, 2 Drawing Sheets

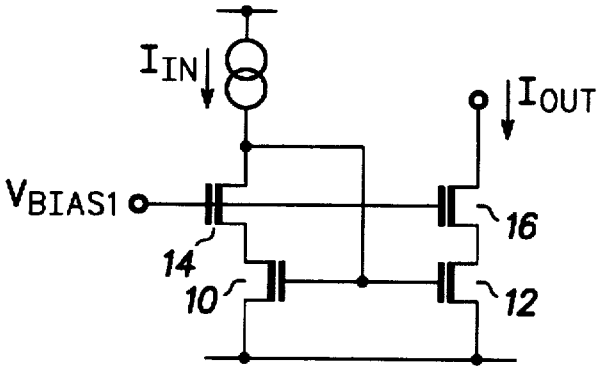
FIG. 1
- PRIOR ART -
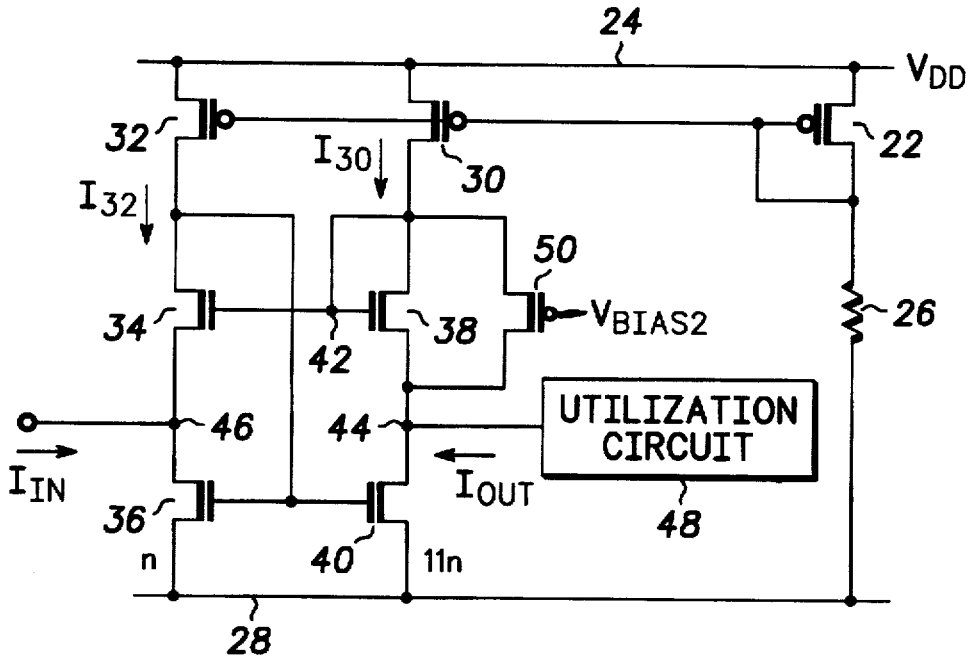
20 FIG. 2

CIRCUIT AND METHOD OF PROVIDING A CONSTANT CURRENT

BACKGROUND OF THE INVENTION

The present invention relates in general to current sources and, more particularly, to a current source that provides a substantially constant output current at low output voltages.

Current sources are used in a myriad of applications to provide a known output current. Typically applications for a current source are in the fields of telecommunications, automotive control, and industrial motor drivers. More specifically, analog circuits such as amplifiers, power MOS transistor driver control circuits, charge pumps, and other analog functions use a current source to provide a known, constant current.

A conventional MOS current source typically uses a current mirror where an input current is sourced into the common drain-gate junction of a diode-configured input transistor. The gate of the input transistor is also coupled to the gate of an output transistor. The input and output transistors of the current mirror have common sources and consequently equal gate-source junction potentials ($V_{GS}$). If the transistors are matched, then the output transistor conducts an equal current as sourced through the input transistor. The output transistor can be ratioed to provide a multiple or fraction of the input current. The current mirror operates as a current source if the input current is held at a constant value. Bipolar current sources follow an analogous description.

Ideally, the output current of the current source should be constant independent of the output voltage. The output of the current mirror is coupled to some utilization circuit, for example, the common sources of a differential transistor pair, or the control input of a power MOS device. A common problem with using conventional current mirrors as a current source is that the output current is no longer constant as the output voltage decreases below a certain threshold. The following discussion is directed to MOS transistors, although an analogous description applies for bipolar devices. The characteristic family of curves of the output MOS transistor of the current mirror have a saturation region and a linear region as is well known. Each curve represents a different $V_{GS}$ of the output transistor. As long as the drain-source voltage ($V_{DS}$) is above the "knee" of the characteristic curve, the current mirror provides a substantially constant output (drain) current for any $V_{DS}$. Any variation in drain current with $V_{DS}$ is a function of the output impedance of the current mirror, i.e. slope of the curve in the saturation region.

Many applications require a small output voltage for the current source. For example, the power supply to the differential amplifier may be decreased in a battery application. The lower power supply provides less signal dynamic range and requires the output voltage of the current source be kept as small as possible. If the $V_{DS}$ of the output transistor in a conventional current source drops into the linear region, then the drain current decreases radically with lower drain voltages. The output transistor needs a greater $V_{GS}$ to maintain the same drain current. However, the $V_{GS}$ of the output transistor is controlled by the input transistor and the sourced input current. Since the $V_{DS}$ of the input transistor remains equal to its $V_{GS}$ because of the diode-configuration, then the input transistor always operates in its saturation region. Yet, the output transistor can be driven into its linear region with a sufficiently low $V_{DS}$; in which case the current mirror no longer operates as an accurate current source. The output current is no longer constant with a given input current.

Another conventional current source is shown in FIG. 1. An input current $I_{IN}$ flows through transistor 10 and sets up a $V_{GS}$ for transistor 12. Transistor 12 has the same $V_{GS}$ as transistor 10 and conducts an output current $I_{OUT}$ by the current mirror action. Transistors 14 and 16 are cascode devices for transistors 10 and 12. The output of the current source is the drain of transistor 16. Transistors 14 and 16 receive a fixed reference potential $V_{BIAS1}$ at their gates. The characteristic curve of the MOS transistor is still sloped in the saturation region according to the output impedance of the device, and therefore the drain current varies slightly with $V_{DS}$. Transistor 16 operates to stabilize the $V_{DS}$ operating point of transistor 12, i.e. $V_{BIAS1}$ less the $V_{GS}$ voltage of transistor 16, to reduce that slight variation in drain current. However, as the output voltage of the current source decreases, transistor 16 becomes a short and allows transistor 12 to enter its linear region while transistor 10 continues operating in its saturation region. Transistors 10 and 12 no longer conduct equal currents even with equal $V_{GS}$. The current source no longer provides a constant output current. Another limiting characteristic of this configuration is that there are two MOS devices (e.g. transistors 12 and 16) with attendant on-resistance in the output current path which limits operation in the low output voltage range.

Hence, a need exists for a current source that provides a substantially constant output current even at low output voltages.

BRIEF DESCRIPTION OF THE DRAWINGS

FIG. 1 is a schematic diagram illustrating a conventional cascoded current source;

FIG. 2 is a schematic diagram illustrating a current source in accordance with the present invention;

DETAILED DESCRIPTION OF THE PREFERRED EMBODIMENT

Figure 3:
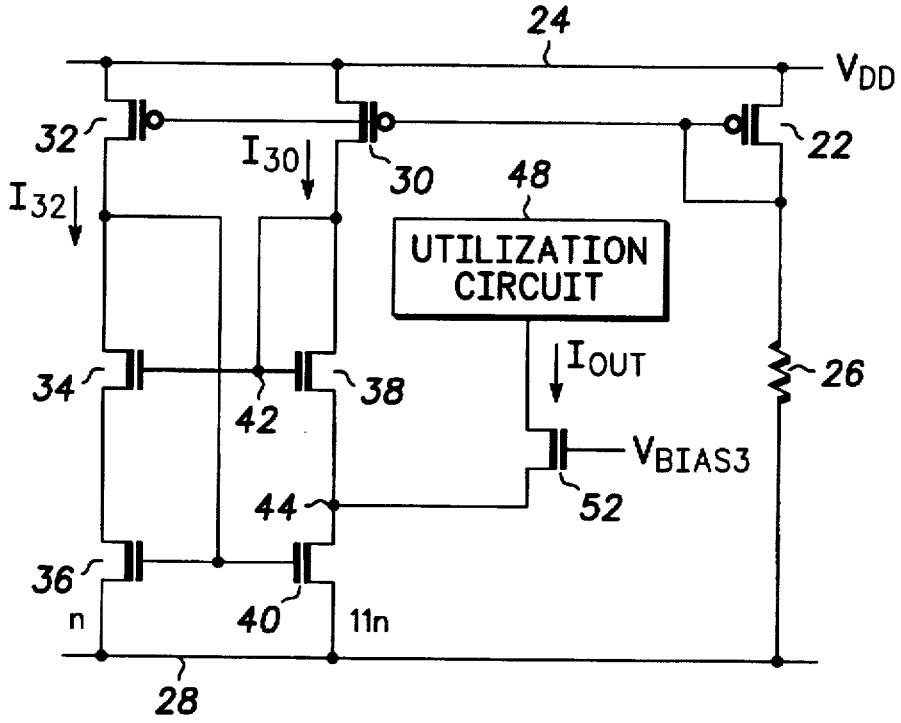
FIG. 3 is a schematic diagram illustrating an alternate embodiment of the current source.

Referring to FIG. 2, a current source 20 is shown suitable for manufacturing as an integrated circuit (IC) using conventional IC processes. Current source 20 includes a diode-configured transistor 22 referenced to power supply conductor 24 operating at a positive power supply potential such as $V_{DD}$=5 volts. The common gate and source of transistor 22 is coupled through resistor 26, or other conduction element, to power supply conductor 28 operating at ground potential. Transistor 22 conducts a substantially constant current of say 10 microamps (μa). Transistors 30 and 32 are also referenced to power supply conductor 24 and have their gates coupled to the gate of transistor 22. Transistors 30 and 32 each have the same $V_{GS}$ as transistor 22 and operate as current sources to conduct 10 μa reference currents $I_{30}$ and $I_{32}$, respectively.

The current $I_{32}$ flows through transistors 34 and 36 and sets up a $V_{GS}$ for transistors 36 and 40. The current $I_{30}$ flows through transistors 38 and 40. Transistors 36 and 40 are configured as a current mirror with the drain and source of transistor 34 serially coupled in the input of the current mirror. Transistor 34 cascodes transistor 36 which is the input to the current mirror. The drain of transistor 40 is the output of the current mirror. The gate of transistor 34 is coupled to the gate and drain of transistor 38. The source of transistor 38 is coupled to the output of the current source at node 44.

Transistors 34 and 38 are matched devices, i.e. same channel width and length and number of sources, and conduct equal currents. The fixed current $I_{30}$ develops a constant $V_{GS}$ for transistor 38. Transistor 38 is configured as a diode with its drain and gate coupled together. The gate voltage of transistor 38 dynamically follows its source voltage. The voltage at node 42 follows the voltage at node 44 offset by the $V_{GS}$ of transistor 38. Similarly, the voltage at node 46 tracks the voltage at node 44 because matched transistors 34 and 38 conduct equal currents and have equal $V_{GS}$ in their saturation region.

Transistor 40 is configured to have a number of sources as a multiple of the number n of sources of transistor 36, e.g. transistor 40 has eleven sources compared to one source for transistor 36. Transistor 40 conducts 11 times the current flowing through transistor 36. With 10 μa of current flowing through transistors 34 and 36, the $V_{GS}$ of transistor 40 is set to sink 110 μa of current. Transistor 30 provides a 10 μa current $I_{30}$ into node 44 resulting in a net 100 μa sink at node 44. Node 44 represents the output of current source 20 and sinks a constant current $I_{OUT}$ from utilization circuit 48. Utilization circuit 48 may for example represent the common sources of a differential transistor pair, the control terminal of a power MOS device, or any other analog circuit requiring a constant current source. Therefore, current source 20 sinks a constant 100 μa current $I_{OUT}$ from utilization circuit 48.

The output current $I_{OUT}$ remains substantially constant over a wide range of voltages at node 44. If the voltage at node 44 is relatively high, such that transistor 40 operates well into its saturation region, then the voltage at node 42 tracks the voltage at node 44 offset by the $V_{GS}$ of transistor 38. Likewise, the voltage at node 46 tracks the voltage at node 42 less the $V_{GS}$ of transistor 34. The voltage at the drain of transistor 34 has an upper limit of the $V_{GS}$ of transistor 36. As the voltage at node 46 approaches that upper limit at the drain of transistor 34, transistor 34 goes into its linear region and effectively becomes a short. Transistor 36 then operates in its saturation region as a diode with its gate shorted to its drain. Transistor 40 operates in its saturation region and conducts 11 times the current in transistor 36 with the same $V_{GS}$. Transistor 38 is operating in its saturation region as a diode sourcing current $I_{30}$ to node 44. The output current $I_{OUT}$ remains substantially constant at $10 \times I_{32}$, which is 100 μa in the present example.

At lower voltages at node 44, say 200 millivolts (mv) or less, the $V_{DS}$ of transistor 40 decreases and enters its linear region. The voltage at node 46 tracks the voltage at node 44 because of the voltage follower action of transistors 34 and 38. With the voltage at node 46 equal to the voltage at node 44, the $V_{DS}$ of transistor 36 is equal to the $V_{DS}$ of transistor 40. Transistor 36 is forced to operate in its linear region similar to transistor 40. In order to conduct the same drain current $I_{32}$ with a smaller $V_{DS}$, the $V_{GS}$ of transistor 36 will increase. The $V_{GS}$ of both transistors 36 and 40 increase together since they have a common gate. With transistors 36 and 40 both operating at the same point in their linear regions and receiving a common gate voltage, the transistors still operate substantially the same with respect to one another. That is, transistor 40 continues to conduct 11 times the current flow in transistor 36. The output current of current source 20 remains substantially constant, even at low output voltages down to say 10 mv.

Thus, a feature of the present invention is coupling the gates of transistors 34 and 38 to the drain of transistor 38 at the output of current source transistor 30. The gate of transistor 38 is allowed to dynamically track its drain which keeps the voltages at nodes 44 and 46 and the $V_{DS}$ of transistors 36 and 40 substantially equal as the output voltage at node 44 falls into the linear region for transistor 40.

The lower limit of output voltage of current source 20 is set by the magnitude of the supply voltage $V_{DD}$. As the voltage at node 44 decreases, the voltage at node 46 and the $V_{DS}$ of transistor 36 also decreases. The $V_{GS}$ of transistor 36 increases to allow transistor 36 to conduct the same current $I_{32}$. The upper limit of $V_{GS}$ of transistor 36 is the supply voltage $V_{DD}$ less the $V_{DS}$ of transistor 32.

Another feature of the present invention shown in FIG. 2 is transistor 50 which becomes active for higher voltages at node 44. The gate of transistor 50 receives a bias voltage $V_{BIAS2}$ operating at a level less than the supply voltage $V_{DD}$, for example $V_{BIAS2}=V_{DD}-V_{DS30}-V_{GS50}$, where the $V_{DS30}$ is the $V_{DS}$ of transistor 30 necessary to keep transistor 30 operating in the saturation region, and $V_{GS50}$ is the $V_{GS}$ of transistor 50. Transistor 38 operates as a diode until the voltage at node 42, which is tracking node 44, approaches $V_{BIAS2}+V_{GS50}$. If the voltage at node 42 increases above $V_{BIAS2}+V_{GS50}$, then transistor 50 turns on and by-passes transistor 38 to keep the 10 μa reference current flowing into node 44.

In another application of the present invention, a signal current $I_{IN}$ can be sourced into node 46 and sunk through transistor 36. The $V_{GS}$ of transistor 36 changes accordingly and imposes the same $V_{GS}$ on transistor 40 so that the output current $I_{OUT}$ increases. In this current mirror application, the number of sources for transistors 36 and 40 will usually be the same. In that case, if current $I_{IN}$ is made 100 μa, then current $I_{OUT}$ goes to 100 μa ((10+100)*1−10).

As an additional feature, current source 20 provides a negative impedance at node 46. By sourcing current $I_{IN}$ into node 46, one would expect the voltage there to rise. However, as discussed above, the voltage at node 46 tracks the voltage at node 44 because the $V_{GS}$ of transistors 34 and 38 cancel. Sinking current $I_{IN}$ into node 46 increases the $V_{GS}$ of transistor 36 and correspondingly the $V_{GS}$ of transistor 40. Transistor 40 sinks current and the voltage at node 44 falls depending on the impedance of utilization circuit 48. The voltage at node 46 falls as well because it tracks the voltage at node 44. Therefore, node 46 effectively becomes a negative impedance because the voltage moves in opposition to the current.

Turning to FIG. 3, another embodiment of the present invention is shown. Circuit elements having the same reference numbers used in FIG. 2 provide a similar function. A transistor 52 has its source coupled to node 44 and its drain provides the output current $I_{OUT}$ of the current source to utilization circuit 48. The gate of transistor 52 receives a bias voltage $V_{BIAS3}$. Transistor 52 fixes the voltage at node 44 to $V_{BIAS3}$ less the $V_{GS}$ of transistor 52. If the drain voltage of transistor 52 decreases to the node 44 voltage, then transistor 52 effectively becomes a short. The maximum voltage at node 44 is $V_{BIAS3}$ less the $V_{GS}$ of transistor 52. Transistor 52 provides the advantages of limiting the voltage swing range at node 44 and maintaining the maximum output impedance which is reflected to the current source output through cascoded transistor 52. With a higher output impedance, the output current remains more constant with variations in output voltage.

Figure 4:
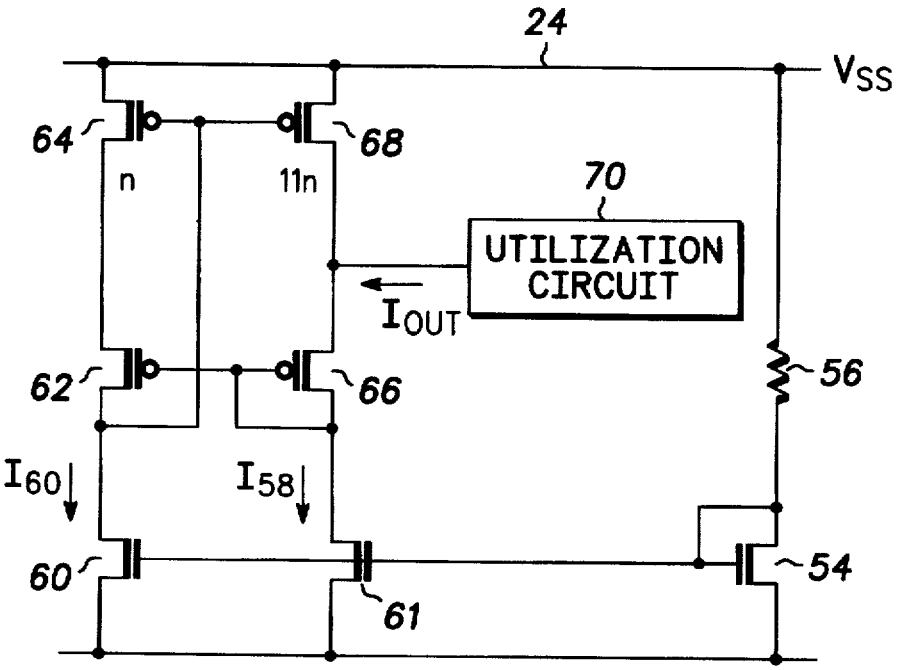
FIG. 4 is a schematic diagram illustrating another embodiment of the current source.

In FIG. 4, another embodiment of the present invention is shown. Transistors 54, 61, and 60 are analogous to transistors 22, 30, and 32, respectively. Transistors 62, 64, 66, and 68 provide the same function as transistors 34, 36, 38, and 40, respectively, to provide a constant current $I_{OUT}$ into utilization circuit 70.

By now it should be appreciated that the present invention provides a current source including a current mirror having an input coupled for receiving a first reference current. A first transistor cascodes the input transistor of the current mirror. A second transistor has a first conduction terminal coupled for receiving a second reference current, and a second conduction terminal coupled to an output transistor of the current mirror. The first conduction terminal of the second transistor is coupled to common control inputs of the first and second transistors. The current source provides a substantially constant output current even at low output voltages. As the output voltage decreases such that the output transistor of the current mirror enters its linear region, the drain-source voltage of the input transistor of the current mirror is forced by the first and second transistors to have the same drain-source voltage and operate in its linear region. With both current mirror transistor operating at substantially the same point in their linear region and receiving the same gate voltage, then the ratio of output current to input current of the current mirror remains constant and the output current of the current source remain constant for a constant input current over a wide range of output voltages.

What is claimed is:

1. A current source, comprising:

a current mirror having an input coupled for receiving a first reference current;

a first transistor serially coupled in the input of the current mirror;

a second transistor having a first conduction terminal coupled for receiving a second reference current, and a second conduction terminal coupled to an output of the current mirror, where the first conduction terminal of the second transistor is coupled to common control inputs of the first and second transistors; and a third transistor having a first conduction terminal coupled to the output of the current mirror, a control terminal coupled for receiving a bias voltage, and a second conduction terminal for providing an output current of the current source.

2. The current source of claim 1 wherein the current mirror includes:

a fourth transistor having a control terminal coupled to a first conduction terminal of the first transistor, a first conduction terminal coupled to a second conduction terminal of the first transistor, and a second conduction terminal coupled to a first conductor; and a fifth transistor having a first conduction terminal coupled to the second conduction terminal of the second transistor, a second conduction terminal coupled to the first conductor, and a control terminal coupled to the control terminal of the fourth transistor.

3. A current source, comprising:

a current mirror having an input coupled for receiving a first reference current;

a first transistor serially coupled in the input of the current mirror;

a second transistor having a first conduction terminal coupled for receiving a second reference current, and a second conduction terminal coupled to an output of the current mirror, where the first conduction terminal of the second transistor is coupled to common control inputs of the first and second transistors; and a third transistor having a first conduction terminal coupled to the first conduction terminal of the second transistor, a control terminal coupled for receiving a bias voltage, and a second conduction terminal coupled to the second conduction terminal of the second transistor.

4. The current source of claim 3 wherein a first node at a first conduction terminal of the first transistor is coupled for receiving an input signal.

5. The current source of claim 3 further including a reference current source having a first output coupled to a second conduction terminal of the first transistor.

6. The current source of claim 5 wherein the reference current source further includes a second output coupled to the first conduction terminal of the second transistor.

7. The current source of claim 6 wherein the reference current source includes:

a fourth transistor having a first conduction terminal coupled to a second conductor, and a second conduction terminal coupled to a control terminal of the fourth transistor;

a conduction element coupled between the second conduction terminal of the fourth transistor and the first conductor;

a fifth transistor having a first conduction terminal coupled to the second conductor, a control terminal coupled to the control terminal of the fourth transistor, and a second conduction terminal coupled to the first conduction terminal of the second transistor; and a seventh transistor having a first conduction terminal coupled to the second conductor, a control terminal coupled to the control terminal of the fourth transistor, and a second conduction terminal coupled to the second conduction terminal of the first transistor.

8. A current mirror, comprising:

a first transistor having a first conduction terminal coupled for receiving a first reference current;

a second transistor having a first conduction terminal coupled to a second conduction terminal of the first transistor, a second conduction terminal coupled to a first conductor, and a control terminal coupled to the first conduction terminal of the first transistor;

a third transistor having a first conduction terminal coupled for receiving a second reference current, and a control terminal coupled to the first conduction terminal of the third transistor and to a control terminal of the first transistor;

a fourth transistor having a first conduction terminal coupled to a second conduction terminal of the third transistor, a second conduction terminal coupled to the first conductor, and a control terminal coupled to the control terminal of the second transistor; and a fifth transistor having a first conduction terminal coupled to the first conduction terminal of the third transistor, a control terminal coupled for receiving a bias voltage, and a second conduction terminal coupled to the first conduction terminal of the fourth transistor.

9. The current mirror of claim 8 further including a reference current source having a first output coupled to the first conduction terminal of the first transistor, and a second output coupled to the first conduction terminal of the third transistor.

10. The current mirror of claim 9 wherein the reference current source includes:

a sixth transistor having a first conduction terminal coupled to a second conductor, and a second conduction terminal coupled to a control terminal of the sixth transistor;

a conduction element coupled between the second conduction terminal of the sixth transistor and the first conductor;

a seventh transistor having a first conduction terminal coupled to the second conductor, a control terminal coupled to the control terminal of the sixth transistor, and a second conduction terminal coupled to the first conduction terminal of the third transistor; and an eighth transistor having a first conduction terminal coupled to the second conductor, a control terminal coupled to the control terminal of the sixth transistor, and a second conduction terminal coupled to the first conduction terminal of the first transistor.

11. An integrated circuit, comprising:

a current source having an output for providing an output current, the current source including, (a) a first transistor having a first conduction terminal coupled for receiving a first reference current, (b) a second transistor having a first conduction terminal coupled to a second conduction terminal of the first transistor, a second conduction terminal coupled to a first conductor, and a control terminal coupled to the first conduction terminal of the first transistor, (c) a third transistor having a first conduction terminal coupled for receiving a second reference current, and a control terminal coupled to the first conduction terminal of the third transistor and to a control terminal of the first transistor, (d) a fourth transistor having a first conduction terminal coupled to a second conduction terminal of the third transistor and further coupled to the output of the current source, a second conduction terminal coupled to the first conductor, and a control terminal coupled to the control terminal of the second transistor, and (e) a fifth transistor having a first conduction terminal coupled to the first conduction terminal of the fourth transistor, a control terminal coupled for receiving a bias voltage, and a second conduction terminal for providing the output current of the current source; and a utilization circuit coupled to the output of the current source.

12. The current source of claim 11 wherein a first node at the first conduction terminal of the second transistor is coupled for receiving an input signal.

13. The current source of claim 11 further including a reference current source having a first output coupled to the first conduction terminal of the first transistor, and a second output coupled to the first conduction terminal of the third transistor.

14. The current source of claim 13 wherein the reference current source includes:

a sixth transistor having a first conduction terminal coupled to a second conductor, and a second conduction terminal coupled to a control terminal of the sixth transistor;

a conduction element coupled between the second conduction terminal of the sixth transistor and the first conductor;

a seventh transistor having a first conduction terminal coupled to the second conductor, a control terminal coupled to the control terminal of the sixth transistor, and a second conduction terminal coupled to the first conduction terminal of the third transistor; and an eighth transistor having a first conduction terminal coupled to the second conductor, a control terminal coupled to the control terminal of the sixth transistor, and a second conduction terminal coupled to the first conduction terminal of the first transistor.

* * * * *